US009988256B2

(12) United States Patent
Salem

(10) Patent No.: US 9,988,256 B2
(45) Date of Patent: Jun. 5, 2018

(54) ADJUSTABLE SODA DISPENSER HOLDING DEVICE AND METHOD

(71) Applicant: Mohamed Salem, Fort Lauderdale, FL (US)

(72) Inventor: Mohamed Salem, Fort Lauderdale, FL (US)

( * ) Notice: Subject to any disclaimer, the term of this patent is extended or adjusted under 35 U.S.C. 154(b) by 132 days.

(21) Appl. No.: 15/143,904

(22) Filed: May 2, 2016

(65) Prior Publication Data

US 2016/0318751 A1 Nov. 3, 2016

Related U.S. Application Data

(60) Provisional application No. 62/155,010, filed on Apr. 30, 2015.

(51) Int. Cl.

| | |
|---|---|
| ***A47K 1/08*** | (2006.01) |
| ***B67D 1/16*** | (2006.01) |
| ***B67D 1/08*** | (2006.01) |
| ***B67D 1/00*** | (2006.01) |
| ***B67D 1/06*** | (2006.01) |

(52) U.S. Cl.

CPC ..... *B67D 1/16* (2013.01); *B67D 1/0084* (2013.01); *B67D 1/06* (2013.01); *B67D 1/0889* (2013.01)

(58) Field of Classification Search

CPC ..... B67D 1/16; B67D 1/0889; B67D 1/0084; B67D 1/00; B67D 1/08

USPC ..... 248/309.1, 311.2, 312.1, 231.71; 137/313; 141/86, 88; 222/108, 538, 539

See application file for complete search history.

(56) References Cited

U.S. PATENT DOCUMENTS

| | | | | |
|---|---|---|---|---|
| 699,481 | A * | 5/1902 | Boyd | |
| 1,703,284 | A * | 2/1929 | Wolfe | B67D 1/16 137/312 |
| 1,826,486 | A * | 10/1931 | Walker | B67B 7/18 141/328 |

(Continued)

FOREIGN PATENT DOCUMENTS

| | | | |
|---|---|---|---|
| CA | 2260352 A1 | * | 7/2000 |
| WO | WO2008109964 | * | 9/2008 |

OTHER PUBLICATIONS http://www.manitowocfsusa.com/asset/?id=aiatq at p. 19.

(Continued)

*Primary Examiner* — Gwendolyn W Baxter
(74) *Attorney, Agent, or Firm* — Greg M. Popowitz; Assouline & Berlowe, P.A.

(57) ABSTRACT

An adjustable soda dispenser holding device for securing a soda dispenser to an object including a frame, where the frame includes a horizontal elongated member for abutting a top of the object, a vertical elongated member being connected to the horizontal elongated member and abutting a side of the object, a platform having an inside rim, the inside rim surrounding an opening formed in the platform, and a drip cup for catching drips from a soda dispenser, the drip cup being supported by the inside rim and being rotatable relative to the platform. A method of using an adjustable soda dispenser holding device, including inserting a drip cup into an inside rim surrounding an opening formed in a platform of a frame, where the frame includes a horizontal elongated member and vertical elongated member, and rotating the drip cup relative to the platform.

13 Claims, 8 Drawing Sheets

(56) References Cited

U.S. PATENT DOCUMENTS

| | | | | |
|---|---|---|---|---|
| 5,960,995 | A * | 10/1999 | Leatherman | B67D 1/16 137/313 |
| 6,968,979 | B2 * | 11/2005 | Gribble | B67D 1/16 141/86 |
| 7,900,798 | B1 * | 3/2011 | Allen | A46B 17/02 221/1 |
| 8,448,821 | B2 * | 5/2013 | Hecht | B67D 1/0084 222/108 |
| 9,440,838 | B1 * | 9/2016 | Paige | B67D 3/0067 |
| 2010/0065583 | A1 * | 3/2010 | Leggett | B67D 1/16 222/108 |
| 2012/0067921 | A1 * | 3/2012 | Shippen | B67D 3/0025 222/144 |

OTHER PUBLICATIONS http://www.schroederamerica.com/products/bar-gun-beverage-dispenser/805-0002%20SA%20Install%20Bargun.pdf at p. 14.
http://www.barware.com.au/assets/brochures/BGH-Black.pdf.

* cited by examiner

ADJUSTABLE SODA DISPENSER HOLDING DEVICE AND METHOD

CROSS-REFERENCE TO RELATED APPLICATIONS

This patent application claims the benefit under 35 U.S.C. § 119(e) of U.S. Provisional Patent Application No. 62/155,010, filed Apr. 30, 2015, which application is incorporated herein by reference.

FIELD OF THE INVENTION

The invention broadly relates to a soda dispenser device holder, more specifically to an adjustable soda dispenser holding device, and even more particularly to method of using an adjustable soda dispenser holding device.

BACKGROUND OF THE INVENTION

Soda gun dispensers are used throughout the restaurant and bar industry. The dispenser allows restaurants, namely bartenders, to quickly pour mixed drinks or other beverages to patrons. A typical soda dispenser, also referred to as a soda gun, includes multiple beverage selection buttons, each of which provides the bartender access to a different liquid beverage.

For instance, a soda gun dispenser's buttons may include carbonated beverages, non-carbonated beverages, wine, water, fruit juices, and other common beverages. This wide array of beverage selections allow a bartender to quickly pour a single or mixed drink to a patron, oftentimes mixed with a liquor. Bartenders are in high demand during peak hours, such as "happy hour". Due to the fast paced nature of the bar and restaurant atmosphere, along with the peak demand at certain post work and nightclub times, the soda gun dispenser is used frequently and quickly by bartenders.

Presently, a soda gun dispenser, when not being used by the bartender, is placed in a holder that is attached to the bar countertop. To allow the bartender easy access to the soda gun dispenser, the holder is often attached to the inside of the bar countertop, i.e. behind the bar, within arms reach of the bartender. The nozzle of the dispenser, where the beverage is dispensed from, is placed into a cup in the holder.

The location for the dispenser holder on countertops differs from restaurant to restaurant and bar to bar. Presently, dispenser holders are secured to bar countertops by screwing the holder to the underside of the countertop. Screws are used to affix the dispenser holder to a bar countertop. Although screws can be removed, this method of attachment permanently damages the countertop and creates a permanent mounting location to the bar countertop. The holder is mounted to the countertop at an optimal location and oftentimes never removed, unless the holder needs to be replaced. Given the frequent use of the soda gun and the repeated placement of the soda gun, with dripping liquids on the nozzle, into the dispenser holder, there is a need for a better dispenser holder and drip cup that can be removed from the bar countertop.

Presently, pilot holes are drilled into the countertop to attach the holder to the countertop. This provides a path for the screws to travel into the countertop, which helps to prevent splitting or fracturing of the countertop during installation. Historically, countertops were made from a variety of wood materials. Drilling holes into wood to install the holder with screws was quite common and poses no significant hurdles for the installer. However, more and more restaurants and bars are moving away from wood countertops towards more elegant granite, marble, and quartz materials, to name a few.

As the bartender finishes using the soda dispenser, liquid remains on the nozzle of the dispenser. When the dispenser is placed into the dispenser holder, the excess liquid on the nozzle splashes around the dispenser holder. Although there is a drain in the dispenser holder drip cup to remove this excess liquid, the drain or drip cup itself is often clogged. Present drip cups are difficult to remove. This causes an accumulation of liquid in the dispenser holder. This excess liquid pours over the holder and accumulates on the countertop surface, particularly the underneath portion of the countertop. The excess liquid also drips below the dispenser holder, often into the ice box below used to store ice that the bartender uses to mix drinks. Oftentimes, it is more effective to replace the entire dispenser holder when the drip cup is dirty, clogged, or growing mold.

Unfortunately, the accumulation of liquid on wood and similar absorbent countertop materials creates an unsanitary condition over time. The stagnant liquid, especially for inaccessible and non-visible locations, results in moisture accumulation and ultimately mildew, if left unchecked. Mildew and the resulting mold, in a restaurant setting, creates major health and sanitary issues for the restaurant. Health inspectors issue citations and/or fines for such unsanitary conditions where food and beverages are served to the public. In extreme circumstances, unsanitary conditions can result in restaurants being closed by the local health inspector.

Since current dispenser holders are screwed into the countertop and rarely, if ever, removed for cleaning, mildew persists unchecked for extensive periods of time. Moreover, a vast number of dispenser holders are located immediately above the ice box, where bartenders scoop ice for drink preparation. Needless to say, the dripping of mildew contaminated liquid into an ice reservoir, the contents of which are placed directly into beverage glasses, is a major sanitary hazard. Presently, there is no simple way to removably attach a dispenser holder to an ice box to prevent the dispenser holder from being mounted on the countertop above the ice box, where mildew can grow and migrate into the ice box.

The current trend in restaurants and bars, especially upscale locations catering to high end clientele, is to use high end materials for bar countertops. Instead of wood materials, new restaurants and remodeled restaurants are using granite, marble, quartz, and similar high quality materials to create an elegant experience for patrons. These materials are more resistant to water absorption, which reduces the impact of mold and bacteria formation.

However, mounting a soda dispenser holder onto these surfaces creates installation problems. Marble and similarly hard, brittle surfaces break easily under pressure, like that of a drill bit used to pre-drill pilot holes for mounting screws. Attempting to install a dispenser holder into these types of countertop materials creates a high risk for significant damage to the countertop. As a result, numerous dispenser gun installers choose not to install the dispenser holder directly onto the countertop to avoid damaging the expensive countertop. Alternatively, a piece of wood is permanently affixed to the underside of a high end countertop to allow the dispenser holder to be attached using conventional screw fasteners without directly impacting the non-wood countertop material. Although this solves the mounting problem, the use of wood does not reduce or eliminate the proliferation of mold and other bacteria under the countertop and near food preparation areas, e.g. the ice box.

As can be derived from the variety of devices and methods directed at holding a soda gun dispenser onto a bar countertop, many means have been contemplated to accomplish the desired end, i.e., screwing the holder directly to the countertop. Heretofore, tradeoffs between adjustability and cleanliness were required. Thus, there is a long-felt need for a movable soda gun dispenser holder to allow for cleaning and repositioning. There is a further long-felt need for an adjustable mounting mechanism to attach the dispenser holder to a countertop or ice box without damaging the mounting surface itself.

BRIEF SUMMARY OF THE INVENTION

The present invention broadly comprises an adjustable soda dispenser holding device for securing a soda dispenser to an object including a frame, where the frame includes a horizontal elongated member for abutting a top of the object, a vertical elongated member being connected to the horizontal elongated member and abutting a side of the object, a platform having an inside rim, the inside rim surrounding an opening formed in the platform, and a drip cup for catching drips from a soda dispenser, the drip cup being supported by the inside rim and being rotatable relative to the platform.

In a further embodiment, the present invention includes a method of using an adjustable soda dispenser holding device, including inserting a drip cup into an inside rim surrounding an opening formed in a platform of a frame, where the frame includes a horizontal elongated member and vertical elongated member, and rotating the drip cup relative to the platform.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term soda "gun" is synonymous with terms such as "dispenser", "sprayer", "machine", "mechanism", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
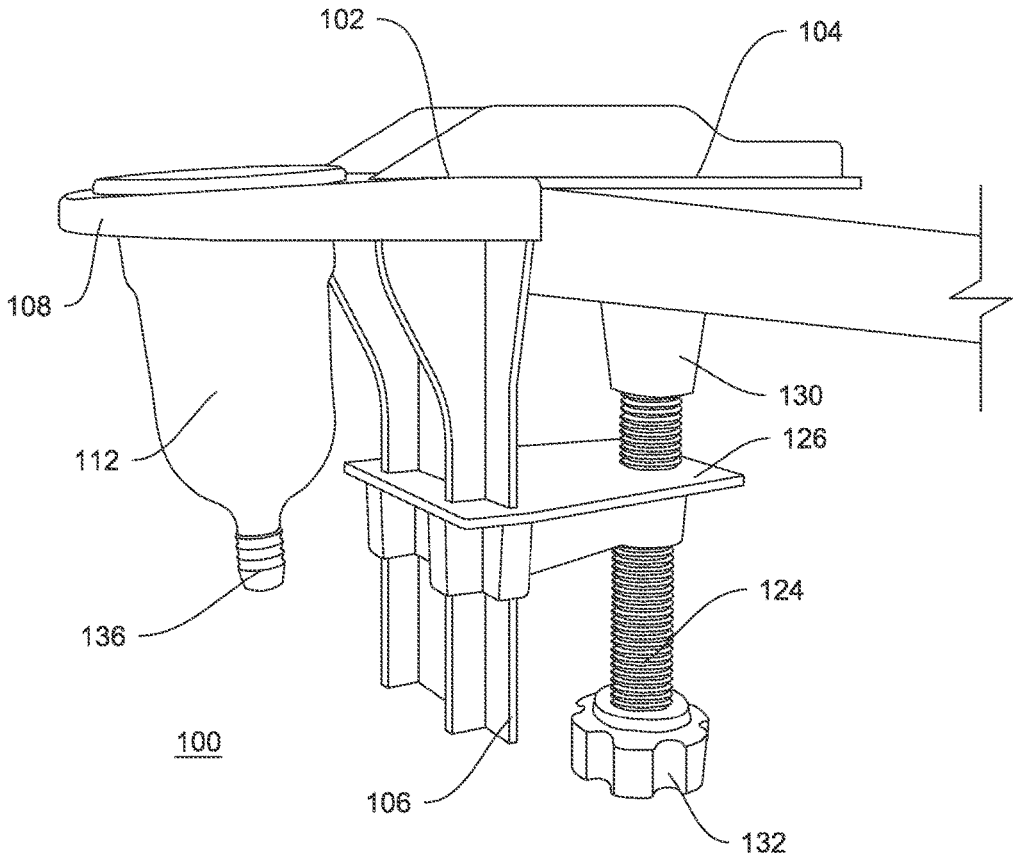
FIG. 1 is a front perspective view of the dispenser holder assembly positioned on a countertop.

Adverting now to the figures, FIG. 1 shows a front perspective view of the complete dispenser holder assembly 100 (the "holder") positioned on a countertop. Holder 100 includes two subassemblies, frame 102 (shown in FIG. 7) and clamp assembly. Frame 102 is used alone or in conjunction with a clamp assembly. FIG. 1 shows the frame, along with drip cup 112, engaged with countertop, such as, but not limited to: wood, granite, quartz, or marble materials found in restaurants and bars.

Holder 100 is used to secure a soda dispenser, i.e. soda gun 200, to an object. As defined herein, an object includes, but is not limited to a countertop (shown in FIG. 1) and ice bin (shown in FIG. 2). Holder 100 includes frame 102, which is formed of multiple components. Frame 102 includes a horizontal elongated member 104 that is positioned on top of the countertop depicted in FIG. 1. A vertical elongated member 106 is connected to horizontal elongated member 104 and positioned on a side, or edge, of the countertop.

In an example embodiment, the underneath portions of horizontal elongated member 104 and vertical elongated member 106 that contact surfaces of the object include a base protector. The base protectors allow holder 100 to make contact with and be secured to a surface on an object, such as a countertop or ice bin, without damaging the surface under normal operation. The protectors provide a cushion between the present invention and the surface the holder 100 is secured to.

The connection of horizontal elongated member 104 to vertical elongated member 106 is shown in FIG. 1 as a right angle. However, horizontal elongated member 104 and vertical elongated member 106 can be connected in acute and obtuse angle configurations to position frame 102 on a wide array of countertops and objects. Positioning frame 102 on an object provides a resting location for a soda gun 200 while not in use by an operator. In another exemplary embodiment, a hinge connects horizontal elongated member 104 and vertical elongated member 106 to allow frame 102 to collapse.

Figure 7:
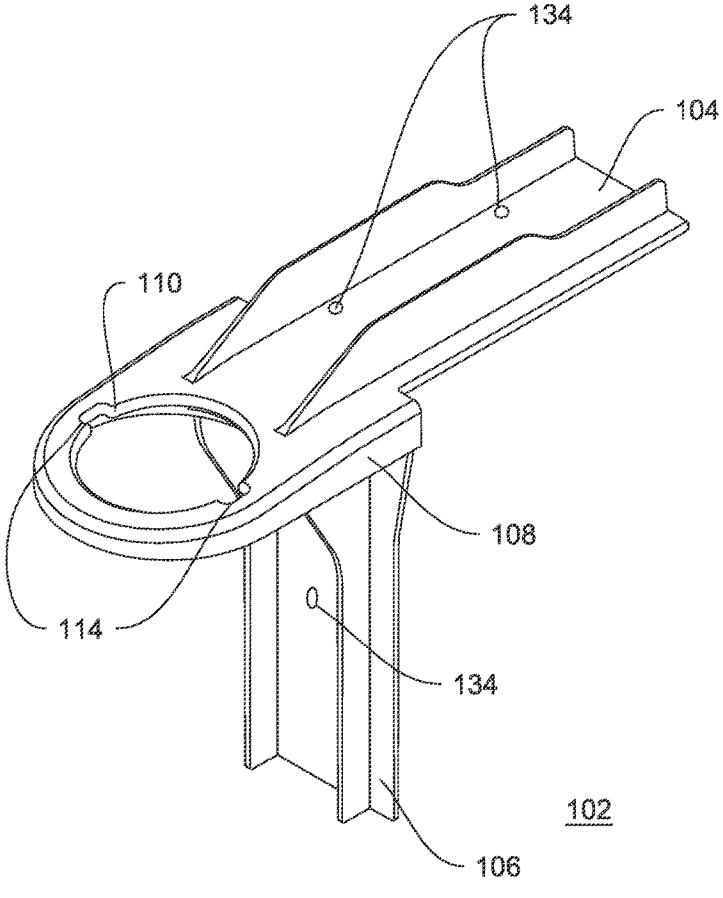
FIG. 7 is a front perspective view of the frame of the dispenser holder.

Frame 102 also includes platform 108 that is connected to horizontal elongated member 104, vertical elongated member 106, or both. Platform 108 has an inside rim 110, as shown in FIG. 7, that surrounds an opening in platform 108. In FIG. 1, platform 108 is an extension of horizontal elongated member 104. Vertical elongated member 106 is connected to platform 108 to create frame 102.

Device 100 includes drip cup 112 that catches, or contains, liquids from a soda gun 200 when the soda gun 200 is place inside drip cup 112. After soda gun 200 is used to prepare a beverage, excess liquid remains at the nozzle of the soda gun 200. Drip cup 112 catches the excess liquid from the soda gun 200 when the soda gun 200 nozzle is placed into drip cup 112 for storage, i.e. the soda gun 200 is not being used. Given the fast pace of bartenders pouring drinks to customers, a soda gun 200 routinely has excess liquid dripping from the nozzle.

Figure 10:
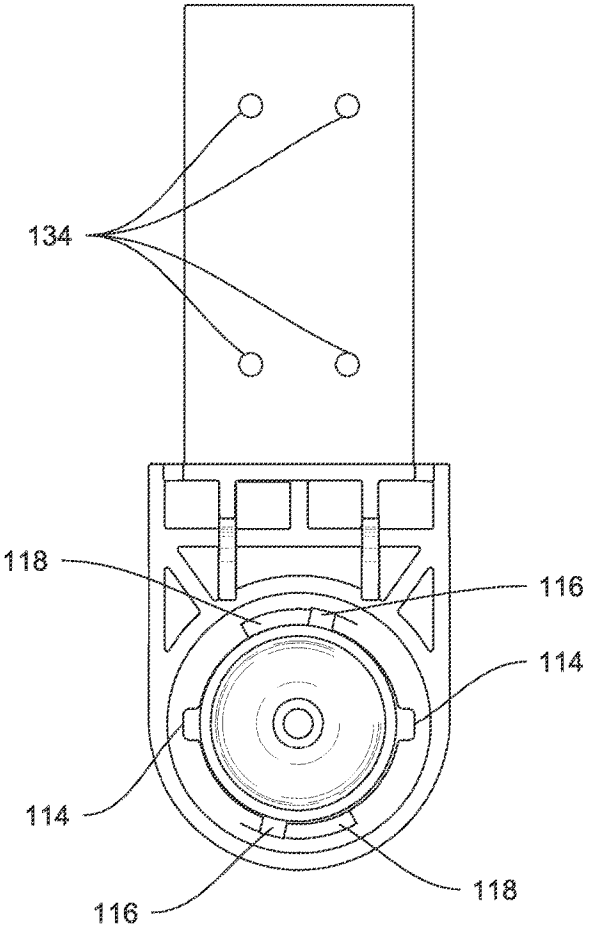
FIG. 10 is a bottom view of the frame and drip cup where the drip cup rips are rotated counter-clockwise about the frame with the drip cup ribs engaged with the frame friction ramps.
Figure 9:
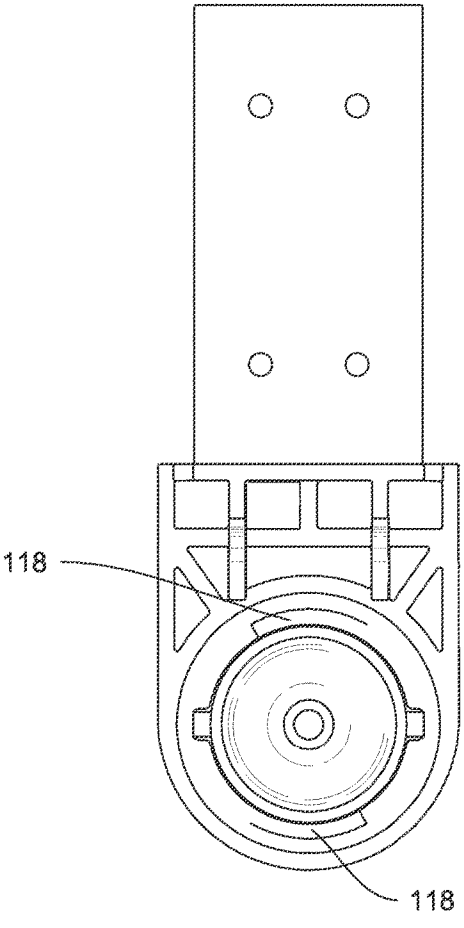
FIG. 9 is a bottom view of the frame and the drip cup where the drip cup ribs are positioned in the frame notches at the initial insertion location, i.e. a zero position.
Figure 11:
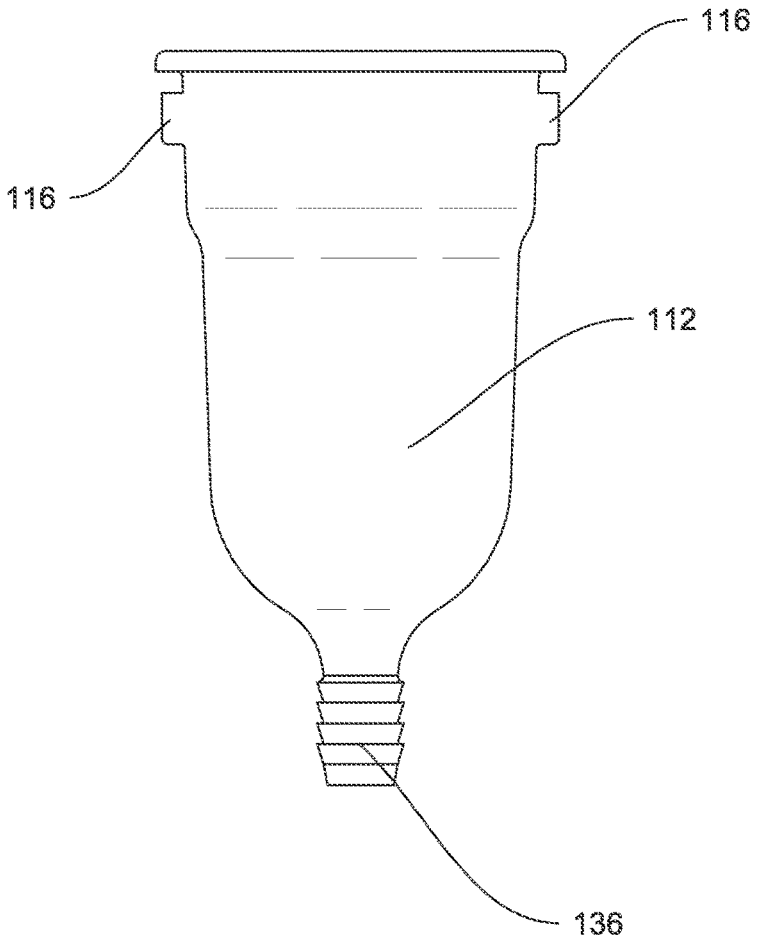
FIG. 11 is a front view of the drip cup with ribs.
Figure 12:
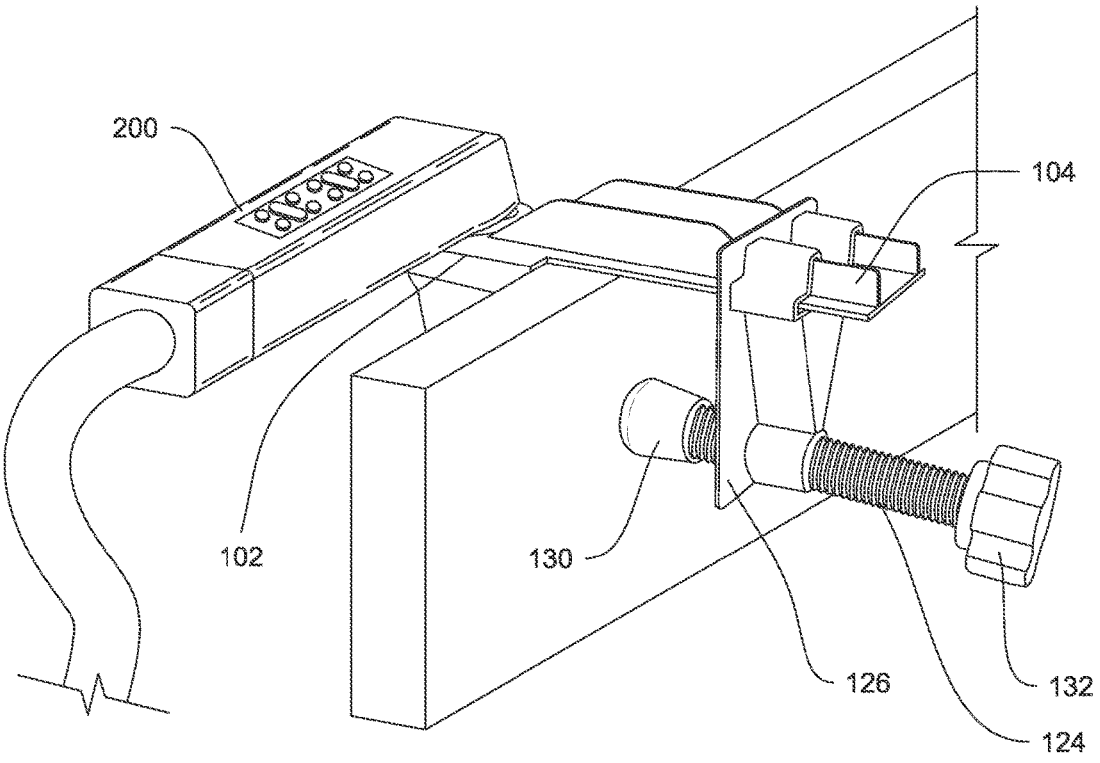
FIG. 12 is a rear perspective view of the clamp assembly of the dispenser holder showing a soda gun.

When placed into platform 108, drip cup 112, shown in FIGS. 11 and 12, is supported by the inside rim 110. After drip cup 112 is positioned within inside rim 110, drip cup 112 is rotated about platform 108 to secure drip cup 112 onto frame 102. As shown in FIGS. 9 and 10, drip cup 112 rotates about platform 108 in a counterclockwise position, as viewed from the underneath surface of platform 108.

Figure 2:
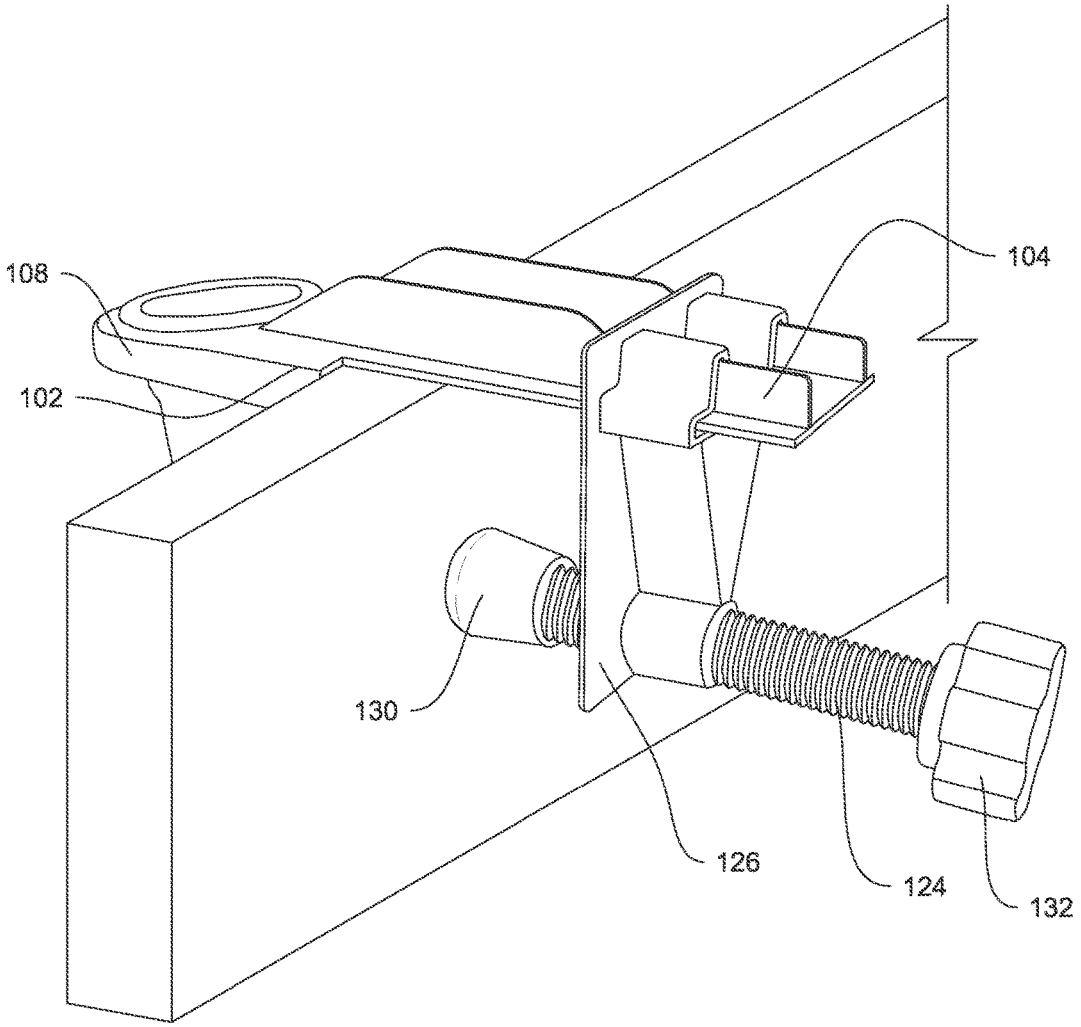
FIG. 2 is a front perspective view of the dispenser holder assembly positioned on an ice box.

FIG. 2 shows the frame assembly and clamp assembly positioned on vertical surface, such as an ice box. Frame assembly (FIG. 7) and drip cup 112 can be used alone, or in conjunction with the clamp assembly.

Figure 8:
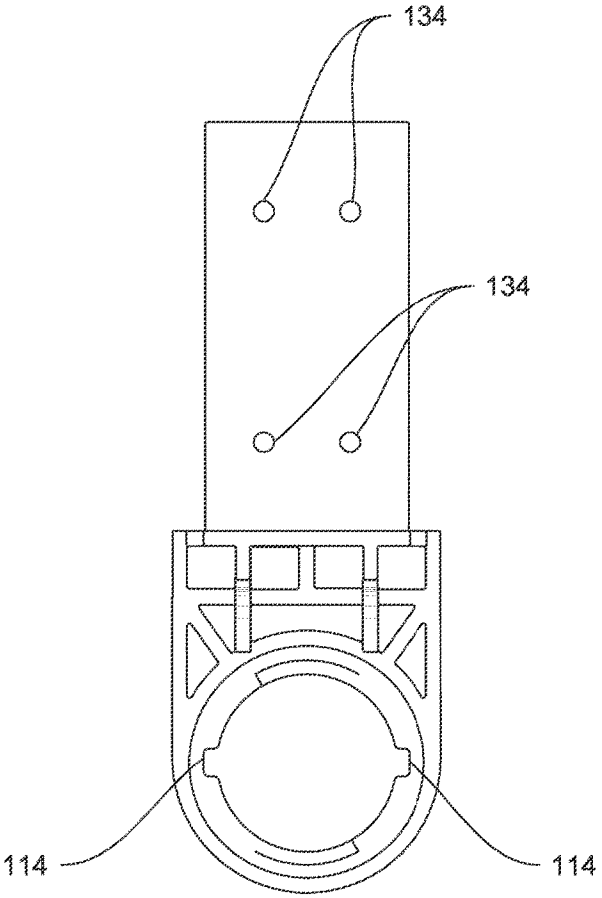
FIG. 8 is a bottom view of the frame depicted in FIG. 7 showing the frame notches and frame friction ramps.

FIGS. 7-10 show an exemplary embodiment of the present invention where the profile of inside rim 110 includes two notches 114. As shown in FIG. 8, notches 114 are recessed portions along the profile of inside rim 110. Drip cup 112 also includes two ribs 116, shown in FIG. 11, protruding from the exterior upper surface of drip cup 112. The first step to secure drip cup 112 to platform 108 is to align then insert ribs 116 through notches 114 until the drip cup 112 is supported by inside rim 110. Next, drip cup 112 is rotated counter-clockwise relative to platform 108 to secure the drip cup 112 to platform 108.

In another exemplary embodiment, shown in FIGS. 9 and 10, the bottom surface of platform 108 includes two ramps 118. Ramps 118 ascend in a radial direction outward as they travel counter-clockwise on the bottom surface of platform 108. Ramps 118 span a portion of the bottom surface of platform 108 and do not overlap. When drip cup 112 rotates relative to platform 108, ribs 116 contact ramps 118 until sufficient friction force is generated to lock drip cup 112 to platform 108. As depicted in FIGS. 9 and 10, ramps 118 are adjacent to inside rim 110. However, ramps 118 can be set farther back from inside rim 110 to achieve the same desired locking friction force.

Figure 4:
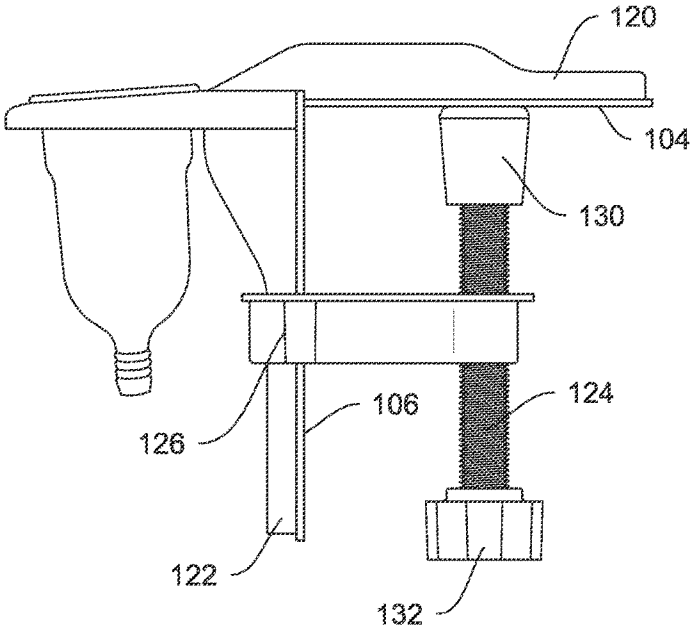
FIG. 4 is a side view of the dispenser holder assembly positioned for mounting on a countertop.
Figure 3:
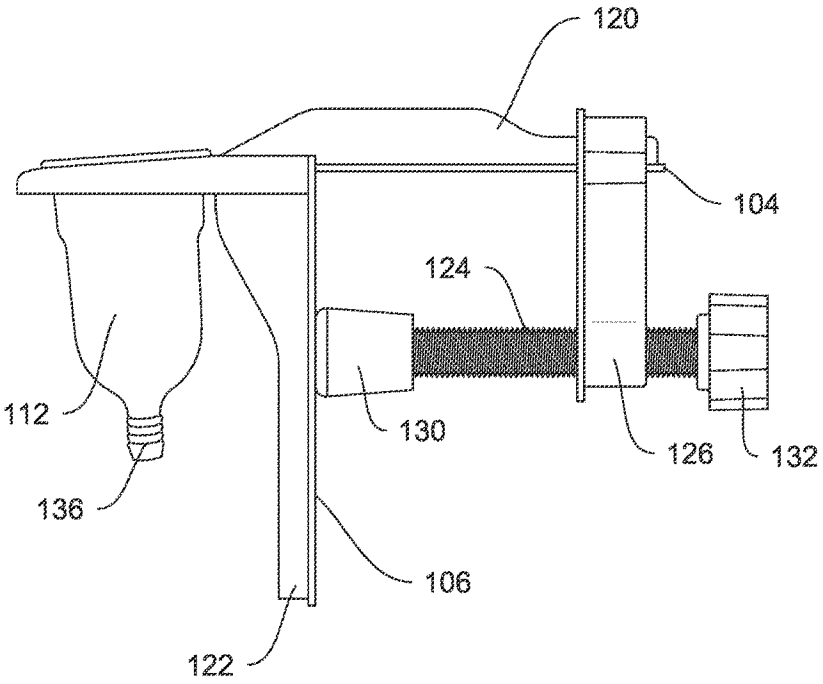
FIG. 3 is a side view of the dispenser holder assembly positioned for mounting on an ice box.

In yet another exemplary embodiment, as shown in FIGS. 3 and 4, horizontal elongated member 104 includes horizontal rail 120 and vertical elongated member 106 includes vertical rail 122. Rails 120 and 122 protrude respectively from horizontal elongated member 104 and vertical elongated member 106 to engage the clamp assembly.

The clamp assembly, as shown in FIG. 1-4, includes clamp rod 124 and clamp arm 126. Clamp arm 126 includes arm slot 128, shown in FIG. 5, that engages with either horizontal rail 120 (FIG. 6) or vertical rail 122. When holder 100 is assembled on a countertop or other horizontal surface, arm slot 128 of the clamp assembly is engaged with vertical elongated member 106 and vertical rail 122. When holder 100 is assembled on an ice bin or other vertical surface, arm slot 128 of the clamp assembly is engaged with horizontal elongated member 104.

In either configuration, the clamp assembly is used to secured frame 102 to an object without having to screw, drill, or otherwise physically impact the object to which the frame is being secured. When frame 102 is used without the clamp assembly, frame 102 is secured to a surface or object by fastening frame 102 to the object directly. FIGS. 7-10 depict where fasteners, such as screws, are passed through fastener holes 134 in horizontal elongated member 104 and vertical elongated member 106 to secure frame 102 to an object.

Holder 100 is used on any material or thickness countertop or ice bin due to the adjustability of the clamp assembly. Moreover, holder 100 is positioned anywhere on the object, e.g. any location on the countertop. This allows a bartender to easily reposition holder 100 depending on whether they are left handed or right handed. Present soda gun holders must be unscrewed and re-screwed to move the holder relative to the countertop. By clamping and unclamping holder 100, the bartender can position and reposition the present invention for optimal use.

Although fastener holes 134 are used herein, frame 102 can be secured through other means directly to an object, without a clamp assembly, such as but not limited to: hook and loop fasteners, adhesive, and button snaps. The use of the clamp assembly eliminates the need to secure frame 102 to an object using a fastening method that can damage the object.

Clamp rod 124 of clamp assembly includes a threaded screw pattern that is rotated relative to screw thread pattern on clamp arm 126. A first end of clamp rod 124 has a stopper 130 and a second end of clamp rod 124 has a handle 132. As an operator turns handle 132 in a clockwise direction, clamp rod 124 rotates within clamp arm 126 until stopper 130 contacts a surface on an object, such as the surfaces depicted in FIGS. 1 and 2. Rotating the handle 132 in a counter-clockwise direction retracts stopper 130 away from the surface of an object. The clamp assembly can be configured to use reverse rotational engagement, i.e. clockwise versus to counter-clockwise.

In an exemplary embodiment, as shown in FIG. 1, holder 100 is engaged with a countertop using the clamp assembly. Frame 102 is positioned on the countertop, with the horizontal elongated member 104 flush to the horizontal surface of the countertop and the vertical elongated member 106 flush to the vertical surface of the countertop. Arm slot 128 of clamp arm 126 is engaged with vertical rail 122 of frame 102 until stopper 130 contacts the bottom of the countertop horizontal surface. Once frame 102 and the clamp assembly is positioned, the operator rotates handle 132 clockwise to increase the force between stopper 130 and the countertop, as well as the force between clamp arm 126 and clamp rod 124, to secure holder 100 to the countertop. Although clamp rod 124 is shown and described as rotating relative to clamp arm 126, clamp rod 124 can engage with clamp arm 126 through other means, such as but not limited to: sliding and preset stop locations, e.g. bar clamps.

In another exemplary embodiment, as shown in FIG. 2, holder 100 is engaged with a vertical surface, such as an ice box, using the clamp assembly. Frame 102 is positioned on the front vertical surface of an ice box, near the top edge of the box. The vertical elongated member 106 flush to the vertical surface of the ice box and the horizontal elongated member 104 flush to the horizontal surface of the ice box. Arm slot 128 of clamp arm 126 is engaged with horizontal rail 120 of frame 102 until stopper 130 contacts the vertical surface of the ice box. Once frame 102 and the clamp assembly is positioned, the operator rotates handle 132 clockwise to increase the force between stopper 130 and the ice box vertical surface, as well as the force between clamp arm 126 and clamp rod 124, to secure holder 100 to the ice box.

Drip cup 112 includes an exit port 136, as shown in FIGS. 1 and 11. When the soda gun 200 nozzle is placed into drip cup 112 for storage, the excess liquid from the soda gun 200 accumulates in the drip cup. Exit port 136 is positioned to direct the accumulating liquids in drip cup 112 to drain out of drip cup 112 through a tube or hose that leads to a drain. Exit port 136 is positioned to direct the exiting liquid away from holder 100, the object holder 100 is mounted to, and the food preparation area. The direction of exit port 136 is angled relative to the longitudinal axis of drip cup 112, i.e. the vertical centerline, in an example embodiment.

Without exit port 136, the liquid accumulating in drip cup 112 would overflow and create spills and unsanitary conditions. In an exemplary embodiment, the outer surface of exit port 136 includes one or several ridges to secure the tube to the drip cup 112. A flexible drain line, such as a tubular plastic material, connects to the exit port 136 to allow the liquids to flow out of the drip cup 112 and into a drain.

At a prescribed length, the flexible drain line opens, allowing the liquid to exit into a reservoir. Through testing and historical use, long flexible drain lines, typically longer than 4 feet, become clogged due to the accumulation of debris and other beverage residue, such as sugar. In an exemplary embodiment, the drain line is ⅜ inch in diameter and 4 feet in length. The drain line includes a detachable plastic cup at the 4 foot length in the event the floor drain is not within 4 feet of the soda gun holder. Instead of the debris and insects accumulating in or near a drain line that exceeds four feet, the detachable plastic cup is serviceable by the restaurant or facility where the present invention is installed.

Horizontal elongated member 104 is also referred to as an upper support platform and vertical elongated member 106 is also referred to as a lower support platform. Platform 108 may be referred to as a cantilever. Lastly, inside rim 110 may be referred to as an inside edge.

The instant invention includes a method of using holder 100 on a object. The minimum steps include first inserting drip cup 112 into an inside rim 110 surrounding an opening formed in a platform 108 of a frame 102. Frame 102 also includes horizontal elongated member 104 and vertical elongated member 106. Second, rotating drip cup 112 relative to platform 108 to secure or lock drip cup 112 into platform 108.

In an exemplary embodiment of the method of using holder 100 an object, drip cup 112 is inserted into inside rim 110 by aligning ribs 116 with notches 114 on inside rim 110. When drip cup 112 is fully seated within platform 108, ribs 116 are below, but aligned with, notches 114 and inside rim 110. This is shown in FIG. 9 where ribs 116 are aligned within notches 114.

As shown in FIG. 10, when drip cup 112 rotates counterclockwise about inside rim 110 of platform 108, ribs 116 rotate relative to notches 114 until secured. In yet another exemplary embodiment, ribs 116 rotate and make contact with ramps 118 until the friction force locks drip cup 112 onto platform 108.

Figure 6:
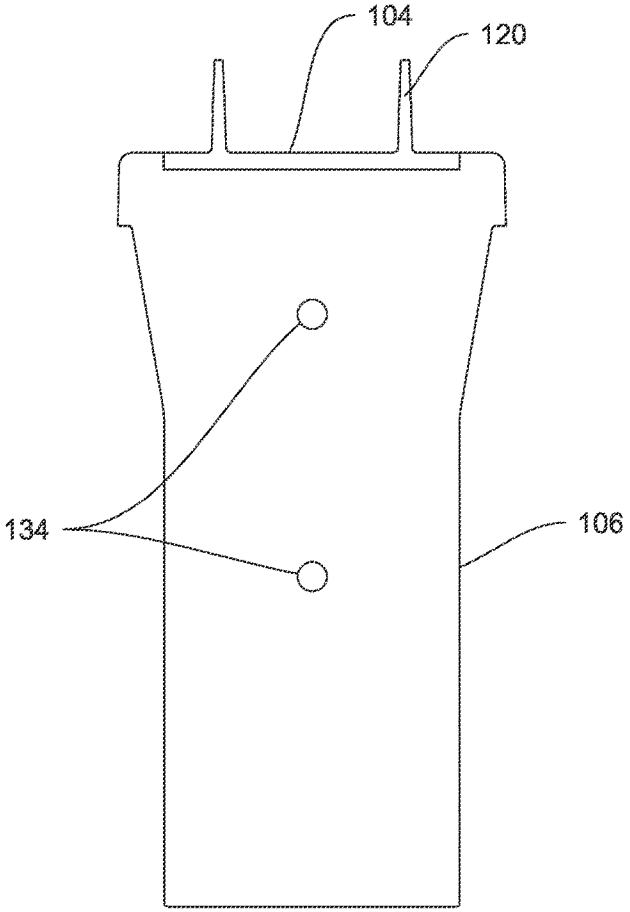
FIG. 6 is a back view of a frame of the dispenser assembly where the horizontal rails of the frame are setup to engage with the clamp assembly depictured in FIG. 5.
Figure 5:
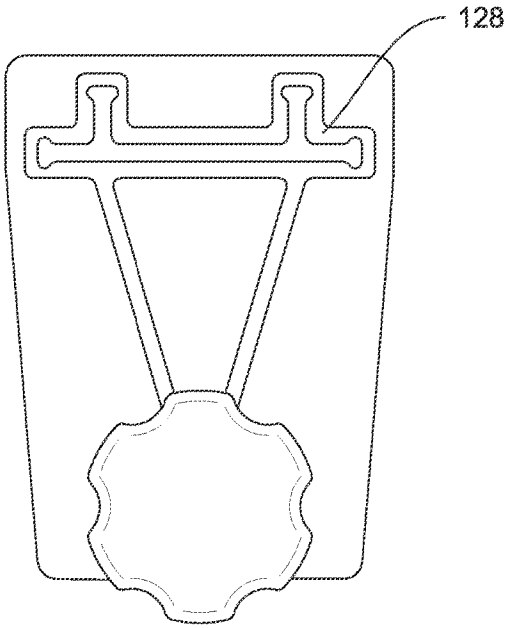
FIG. 5 is a front view of the clamp assembly of the dispenser holder.

Additional steps to secure holder 100 to an object include engaging clamp rod 124 with a first end of clamp arm 126. Then engaging a second end of clamp arm 126 with frame 102 by aligning arm slot 128 with either horizontal elongated member 104 or vertical elongated member 106. In an exemplary embodiment, as shown in FIGS. 5 and 6, arm slot 128 engages respective rails 120 or 122 of either horizontal elongated member 104 or vertical elongated member 106.

An additional exemplary method of using holder 100 includes an operator, e.g. bartender, resting soda gun 200 into drip cup 112 in platform 108. Then liquid drips from the soda gun 200 into drip cup 112. The liquid accumulates in drip cup 112 until it exits through exit port 136. Next, the operator removes drip cup 112 from platform 108 for cleaning by rotating drip cup until ribs 116 align with notches 114, allowing removal. Then the operator cleans drip cup 112 and platform 108 to remove any accumulation of dirt, debris, liquid, syrup, and other common bar contents. This keeps holder 100 and the bar area, including a countertop and ice box, clean and sanitary. Lastly, the operator reinserts drip cup 112 into inside rim 110 of platform 108 by aligning ribs 118 with notches 114 and rotating drip cup 112 relative to platform 108.

The ability of the operator to remove the holder 100 from the countertop allows for cleaning of both the countertop area and the device itself. Routine cleaning eliminates the existing mildew issues associated with stagnant water and liquids that accumulate around the soda gun holder and the countertop. This allows the operator to maintain a sanitary environment, particularly important as restaurants serve food and beverages to patrons.

In yet another exemplary embodiment, the end of horizontal elongated member 104 opposite platform 108 includes a cup holder and wall mount bracket. Bartenders using a soda gun often seek to place the beverage container down on the countertop to mix the drink. Incorporating a cup holder into the present invention for use on a countertop configuration provides a place for the bartender to deposit the beverage container on horizontal elongated member 104 while preparing the drink for the customer.

Moreover, the addition of a wall mount bracket provides another mounting orientation for the present invention when the clamp assembly is not used with frame 102. Instead of securing the present invention onto a countertop, frame 102 with wall mount brackets is hooked onto the upper edge of container, such as an ice box, for a vertical mount configuration. When holder 100 is used on an ice box or other vertical wall, i.e., vertical installation, hooks on frame 102 are engaged with the upper surface of the vertical wall. Notably, in an exemplary embodiment, frame 102 along is installed directly onto a wall, secured using screws through fastener holes 134.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. An adjustable soda dispenser holding device for securing a soda dispenser to an object, comprising:

a frame, wherein said frame includes:

a horizontal elongated member for abutting a top of the object;

a vertical elongated member being connected to said horizontal elongated member and abutting a side of the object; and a platform having an inside rim, said inside rim surrounding an opening formed in said platform; and a drip cup for catching drips from the soda dispenser, said drip cup being supported by said inside rim and being rotatable relative to said platform;

said inside rim defining at least one notch for securing said drip cup to said inside rim; and an outside rim of said drip cup defines at least one rib protruding from said outside rim of said drip cup for securing said drip cup to said inside rim;

wherein said drip cup is inserted into said inside rim by aligning said rib with said notch; and at least one ramp protruding from the bottom surface of said platform, wherein said drip cup rib engages with said ramp when said drip cup is rotated relative to said platform.

2. The adjustable soda dispenser holding device as recited in claim 1, wherein:

said horizontal elongated member includes at least one horizontal rail; and said vertical elongated member includes at least one vertical rail.

3. The adjustable soda dispenser holding device as recited in claim 2, further comprising:

a clamp assembly, including:

a clamp rod, wherein one end of said clamp rod is secured to a surface of said object; and a clamp arm, wherein a first end of said clamp arm is engaged relative to said clamp rod and a second end of said clamp arm is engaged relative to one of the following: said horizontal elongated member, or said vertical elongated member.

4. The adjustable soda dispenser holding device as recited in claim 3, wherein said clamp rod is a threaded screw being rotatable relative to said clamp arm.

5. The adjustable soda dispenser holding device as recited in claim 1, wherein said drip cup includes an exit port.

6. The adjustable soda dispenser holding device as recited in claim 5, wherein an outer surface of said exit port includes a plurality of ridges.

7. An adjustable soda dispenser holding device for securing a soda dispenser to an object, comprising:

a frame, wherein said frame includes:

an upper support platform with at least one protruding rail mounted to a top of the object;

a lower support platform with at least one protruding rail, said lower support platform attached to said upper support platform and mounted to a side of the object;

a cantilever extended from said upper support platform extending past the attachment location of said lower support platform, wherein said cantilever includes an inside edge defining a passage for a drip cup with an exit port;

said drip cup for catching liquids from a soda dispenser, said drip cup resting on said inside edge and removably secured to said cantilever;

a clamp assembly, where said clamp assembly includes:

a clamp rod, wherein one end of said clamp rod is secured to a surface of said object; and a clamp arm, wherein a first end of said clamp arm is engaged relative to said clamp rod and a second end of said clamp arm is engaged relative to one of the following: said upper support platform, or said lower support platform.

8. The adjustable soda dispenser holding device as recited in claim 7, wherein:

said inside edge defining at least one notch for securing said drip cup to said inside edge; and an outside rim of said drip cup defines at least one rib protruding from said outside rim of said drip cup for securing said drip cup to said inside edge;

wherein said drip cup is inserted into said inside edge by aligning said rib with said notch.

9. The adjustable soda dispenser holding device as recited in claim 7, wherein an outer surface of said exit port includes a plurality of ridges.

10. The adjustable soda dispenser holding device as recited in claim 7, further comprising:

at least one ramp protruding from the bottom surface of said cantilever, wherein said drip cup engages with said ramp when said drip cup is rotated relative to said cantilever.

11. A method of using an adjustable soda dispenser holding device, comprising:

inserting a drip cup into an inside rim surrounding an opening formed in a platform of a frame, wherein said frame comprises a horizontal elongated member and vertical elongated member; and rotating said drip cup relative to said platform wherein said drip cup is inserted into said inside rim by aligning at least one drip cup rib with at least one notch on said inside rim; and wherein said horizontal elongated member includes at least one rail and said vertical elongated member contains at least one rail to engage said clamp arm.

12. The method of using the adjustable soda dispenser holding device as recited in claim 11 further comprising engaging one end of said clamp arm with a surface of said object to secure said device to said surface.

13. The method of using the adjustable soda dispenser holding device as recited in claim 11 further comprising:

resting a soda gun into said drip cup;

dripping liquid from the soda gun into said drip cup;

removing said drip cup from said platform for cleaning;

cleaning said drip cup and said platform; and reinserting said drip cup into said inside rim of said platform.

* * * * *